United States Patent [19]

Desaar

[11] Patent Number: 4,724,985

[45] Date of Patent: Feb. 16, 1988

[54] TEEMING LADLES

[76] Inventor: René Desaar, 67 rue Michel Body, 4330 Grâce-Hollogne, Belgium

[21] Appl. No.: 901,508

[22] PCT Filed: Nov. 19, 1985

[86] PCT No.: PCT/EP85/00631

§ 371 Date: Jul. 23, 1986

§ 102(e) Date: Jul. 23, 1986

[87] PCT Pub. No.: WO86/03147

PCT Pub. Date: Jun. 5, 1986

[30] Foreign Application Priority Data

Nov. 23, 1984 [BE] Belgium ..... 214046

[51] Int. Cl.[4] ..... B22D 11/124; B22D 35/06

[52] U.S. Cl. ..... 222/592; 222/591; 164/443; 164/485

[58] Field of Search ..... 222/592, 603, 591, 146.6, 222/598, 600; 164/443, 485; 266/236, 241, 270, 271

[56] References Cited

U.S. PATENT DOCUMENTS

| | | | |
|---|---|---|---|
| 1,145,948 | 7/1915 | Waern | 266/241 X |
| 2,136,394 | 11/1938 | Poland et al. | 164/485 |
| 2,225,660 | 12/1940 | Rogers | 222/591 X |
| 3,570,713 | 3/1971 | Tromel | 222/592 X |
| 4,426,067 | 1/1984 | Hopkins | 266/236 X |

FOREIGN PATENT DOCUMENTS

| | | | |
|---|---|---|---|
| 1527380 | 5/1968 | France | 222/592 |
| 83/01422 | 4/1983 | PCT Int'l Appl. | 222/592 |

*Primary Examiner*—Joseph J. Rolla
*Assistant Examiner*—Nils Pedersen
*Attorney, Agent, or Firm*—Sughrue, Mion, Zinn, Macpeak, and Seas

[57] ABSTRACT

An annular cooling chamber extends around the periphery of a ladle nozzle over at least some of the nozzle length, a hollow ring being so disposed in the annular chamber as to extend coaxially of the runner (casting channel), the ring wall being pierced with orifices along ring length. The ring interior communicates with a cooling fluid supply line, the wall of the annular chamber being formed with an aperture for removal of the cooling fluid distributed by the distributor ring in the annular chamber.

2 Claims, 3 Drawing Figures

TEEMING LADLES

BACKGROUND OF THE INVENTION

This invention relates to teeming ladles, for example, for steel, more particularly to an improvement for cooling the ladle nozzle while the ladle is in use.

Ladle nozzles are refractory bricks lining the wall of the ladle runner (casting channel). Contact of the steel with the refractory brick during teeming erodes the nozzle. Also, when the ladle is returned to maintenance after teeming the runner is still full of largely solidified steel. This carrot or plug of steel must be burnt off with an oxygen lance so as to clean the nozzle wall. In this operation there is severe deterioration of the nozzle because the tip of the burner flame produces at the point of contact a very substantial temperature rise and, therefore, damages the inside surface.

Also, the runner wall in the stationary fixed plate of the teeming system, the plate being disposed below the ladle base, wears very appreciably because of the high temperature of the steel.

SUMMARY OF THE INVENTION

The invention is for an improvement enabling the nozzle to be cooled continuously during teeming and during ladle maintenance work so as to protect the nozzle wall against overheating and thus obviate slow but steady erosion of the wall while teeming is proceeding and damage of the runner wall when maintenance operations are proceeding.

The invention achieves this aim by a teeming ladle distinguished by an annular cooling chamber which extends over the periphery ot the ladle nozzle, a hollow ring being so disposed in the annular chamber as to extend substantially coaxially of the runner, the ring wall being pierced with orifices along ring length, the ring interior communicating with a cooling fluid supply line, the wall of the annular chamber being formed with an aperture for removal of the cooling fluid distributed by the distributor ring. The annular cooling chamber can be formed in the ladle nozzle or by an outer casing which extends around at least some of the nozzle.

The invention, in addition to increasing ladle nozzle life because of the appreciable reduction in the temperature of the runner wall as hereinbefore explained, also ensures effective cooling of the stationary plate of the teeming system, such plate being contiguous to the ladle base; consequently, the life of the nozzle is increased appreciably.

DESCRIPTION OF AN EMBODIMENT

Figure 1:
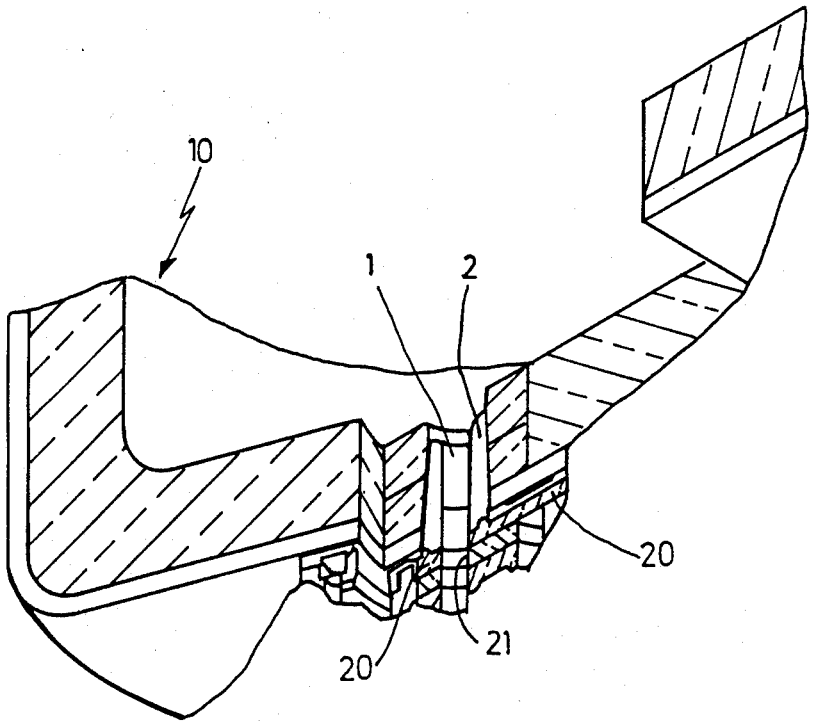
FIG. 1 is a partial perspective view of the base of a runner for steel.

Referring to FIG. 1, there can be seen the bottom of a teeming ladle 10 with a casting channel or runner 1 lined with a refractory brick 2 known as the nozzle. The teeming system hereinbefore referred to has a stationary plate 20.

Figure 2:
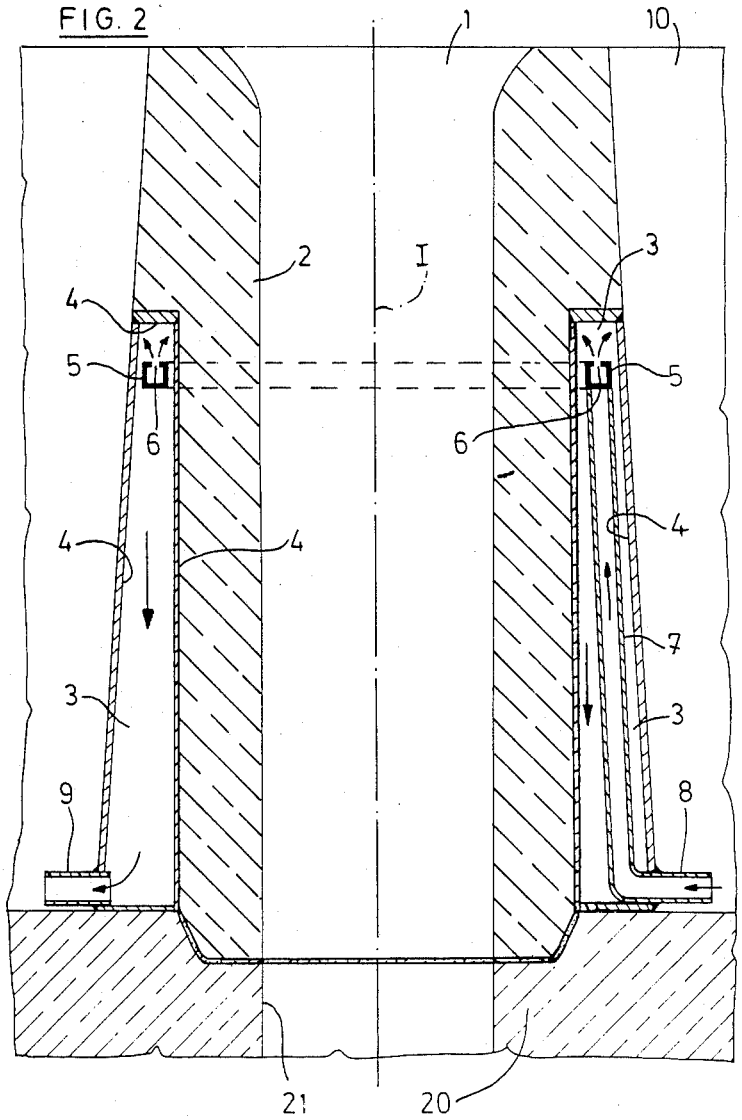
FIG. 2 is a view in section of a first embodiment of a ladle nozzle according to the invention.

According to the invention, the nozzle 2 is embodied with a cooling casing. FIG. 2 illustrates a first embodiment. Over some of its length the nozzle 2 has an annular chamber 3 which is, with advantage, provided internally with a metal casing 4. In the top of the chamber 3 there is a hollow ring 5 which extends in a plane transverse to axis I of the runner 1 and substantially coaxially thereof. The wall of the ring 5 is pierced with orifices 6 right along ring length. Through the agency of the ring 5 a cooling fluid introduced thereinto through a metal duct 7 connected to a cooling fluid supply line 8 is distributed. The ring 5 therefore distributes cooling fluid, for instance compressed air, right around the periphery of the nozzle 2 in the top part of the chamber 3; after having flowed round the ring 5 the cooling fluid flows through the chamber 3 downwardly towards a removal orifice 9 disposed near the transverse plane containing the bottom orifice of the runner 1. If the rate of cooling fluid flow is sufficient, the cooling fluid provides effective cooling of the nozzle 2, thus obviating over rapid deterioration thereof and helping to greatly increase nozzle life.

Also, the cooling facility according to the invention also cools the top part of the plate 20, which is adjacent the nozzle base, and the bottom opening of the runner 1. Consequently, the temperature of the plate 20 can be reduced appreciably, thus obviating excessive and over-rapid wear of runner wall 21 of plate 20.

Figure 3:
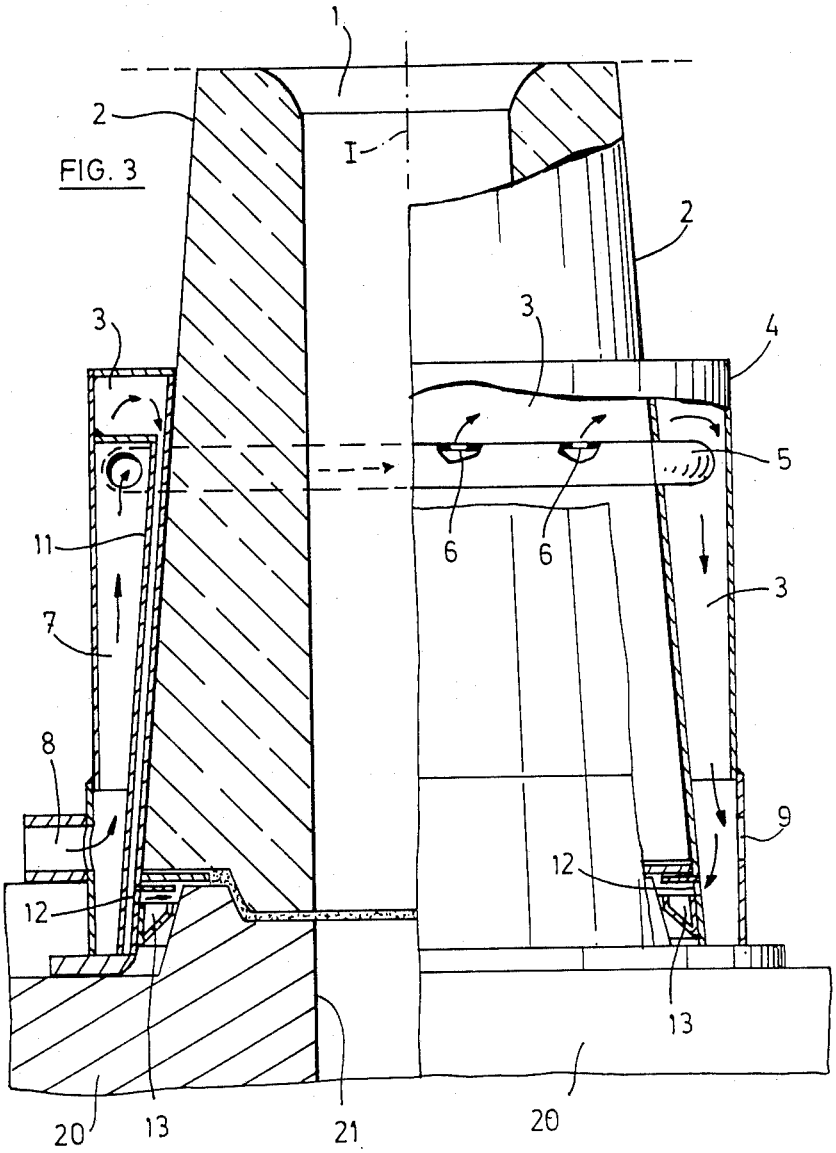
FIG. 3 is a view with partial sectioning of a second embodiment of a ladle nozzle according to the invention.

FIG. 3 shows another embodiment of the facility for cooling the ladle nozzle wherein the annular chamber 3 in which the cooling fluid distributor ring 5 is disposed is embodied by an outer metal casing 4 which extends around at least some of the nozzle 2 and is contiguous with the stationary plate 20. In FIG. 3, numerical references which are the same as in FIG. 2 denote similar or equivalent elements. The cooling fluid introduced into the casing 4 through the supply line 8 is directed towards the ring 5 through the duct 7 embodied inside the casing 4 by an internal metal casing 11, whereafter the cooling fluid is distributed in the top part of the annular chamber 3 through the ring orifices 6 and descends towards the bottom of the casing 4 as indicated by arrows. Some of the cooling fluid is removed through the removal orifice 9.

The inside wall of the casing 4 is pierced in its bottom part with a number of spaced-apart orifices 12 distributed over the entire perimeter to facilitate the passage of some of the cooling fluid towards the top part of the stationary plate 20. Advantageously, an annular duct 13 is arranged to be substantially coaxial of the teeming aperture 21 of the plate 20 to facilitate the flow of the cooling fluid passing through the orifices 12 and thus to act as a cooling sheath at the top of the plate 20. The same is therefore cooled effectively and there is considerably less wear of the teeming hole in the plate 20. Tests showed that the number of teemings possible before the plate 20 needs replacing is increased considerably, with appreciable effect on teeming economics.

What is claimed is:

1. A teeming ladle having a nozzle formed with a runner and having a stationary plate with a hole contiguous to a bottom opening of the runner, said ladle comprising:

an annular cooling chamber extending around the nozzle periphery over at least some nozzle length; and a hollow ring so disposed in the annular chamber as to extend coaxially of the runner, the ring wall being pierced with orifices along the ring length, the ring interior communicating with a cooling fluid supply line, the wall of the annular chamber being formed with an aperture for removal of the cooling fluid distributed by the distributor ring in the annular chamber;

wherein the annular cooling chamber is formed by a casing which extends around at least some of the nozzle; and wherein an inner wall of the casing is formed with bottom orifices in spaced-apart relationship on the wall perimeter for the passage of some of the cooling fluid towards the top of the stationary plate of the teeming ladle.

2. A ladle according to claim 1, comprising an annular channel extending substantially coaxially of the runner to facilitate the flow of the cooling fluid which passes through the bottom orifices and to form a cooling sheath at the top of the stationary plate of the teeming ladle.

* * * * *